United States Patent [19]

Culpepper

[11] 3,977,150

[45] Aug. 31, 1976

[54] MACHINE AND METHOD FOR SUPPLYING ARTICLE CARRIERS FOR APPLICATION TO GROUPS OF ARTICLES

[75] Inventor: Will Lester Culpepper, Tucker, Ga.

[73] Assignee: The Mead Corporation, Dayton, Ohio

[22] Filed: July 21, 1975

[21] Appl. No.: 597,462

[52] U.S. Cl. ..... 53/3; 53/48; 53/49; 53/196; 221/1; 221/218; 221/253

[51] Int. Cl.[2] ..... B65B 21/00

[58] Field of Search ..... 53/3, 35, 48, 196, 49; 221/217–220, 253, 277, 1

[56] References Cited

UNITED STATES PATENTS

| | | | |
|---|---|---|---|
| 2,864,532 | 12/1958 | Gabrielsen | 221/253 X |
| 3,096,575 | 7/1963 | Cook | 53/48 |
| 3,267,638 | 8/1966 | Earp | 53/48 |
| 3,282,025 | 11/1966 | Amberg et al. | 53/299 X |
| 3,334,784 | 8/1967 | Morrison | 221/277 X |
| 3,426,501 | 2/1969 | Earp | 53/48 |
| 3,777,450 | 12/1973 | De Shazor | 53/48 |

*Primary Examiner*—Robert L. Spruill
*Attorney, Agent, or Firm*—Walter M. Rodgers; Walter A. Rodgers

[57] ABSTRACT

A plurality of article carriers are stacked in vertical inverted relationship in a hopper and are supported on a cantilever type support bar mounted at one end only and having its free end extending in one direction so that a plurality of carrier applicator blocks mounted on an endless chain may withdraw sequentially the lowermost carrier from the hopper, each applicator block having a clearance slot therein for slidably receiving the support bar and each applicator block having abutment means disposed on each side of its clearance slot for engaging the lowermost carrier and for moving it off of the support bar and for subsequently re-inverting and applying the carrier to the group of articles moving in synchronism with the endless element.

10 Claims, 6 Drawing Figures

1
2
3
3a
3b
4
4a
12
13
14
15
16
17
18
19
20
21
22
23
24
38
39
C
G1
G2
G3
G4
B1
B3
B5
B2

MACHINE AND METHOD FOR SUPPLYING ARTICLE CARRIERS FOR APPLICATION TO GROUPS OF ARTICLES

U.S. Pat. No. 3,859,773 issued Jan. 14, 1975 discloses a machine for applying plastic type article carriers having apertures therein to a group of bottles disposed at a loading station, the carrier applying motion being vertically reciprocable. Unlike the arrangement of U.S. Pat. No. 3,859,773, this invention utilizes an endless element which is moved in synchronism with groups of articles so that application of the carriers to the groups of articles is effected in a continuous operation by motion which is generally translatory and rotary rather than reciprocatory.

More specifically and in accordance with one form of this invention, plastic type article carriers of the so-called bottleneck gripping type are stacked on a cantilevered support bar in vertical inverted relationship in a vertically disposed hopper and an endless chain having a working reach movable underneath the hopper is provided with a plurality of applicator blocks each having a clearance slot for receiving the cantilever type support bar and each applicator block is provided with abutment means disposed on each side of the clearance slot for engaging parts of the lowermost article carrier and for removing the carrier from the hopper. According to one facet of the invention, holding means is mounted on each applicator bar and engages parts of each carrier so as to hold the carrier in fixed relation on the associated applicator block and high friction means supported by the hopper is arranged to engage each carrier in sequence and in such manner as to urge the carrier into snug engagement with the abutment means so as precisely to position each carrier with reference to its applicator block. In this manner precisely controlled movement of each group of articles brings each group into coincidence with a carrier which is applied as the article group moves without interruption.

For a better understanding of the invention reference may be had to the following detailed description taken in conjunction with the accompanying drawings in which FIG. 1 is a schematic overall side view of a machine constructed according to this invention;

FIG. 4 is a profile view of the trailing side of an applicator block such as is shown in FIG. 3 and in which

Figures 1, 1A:
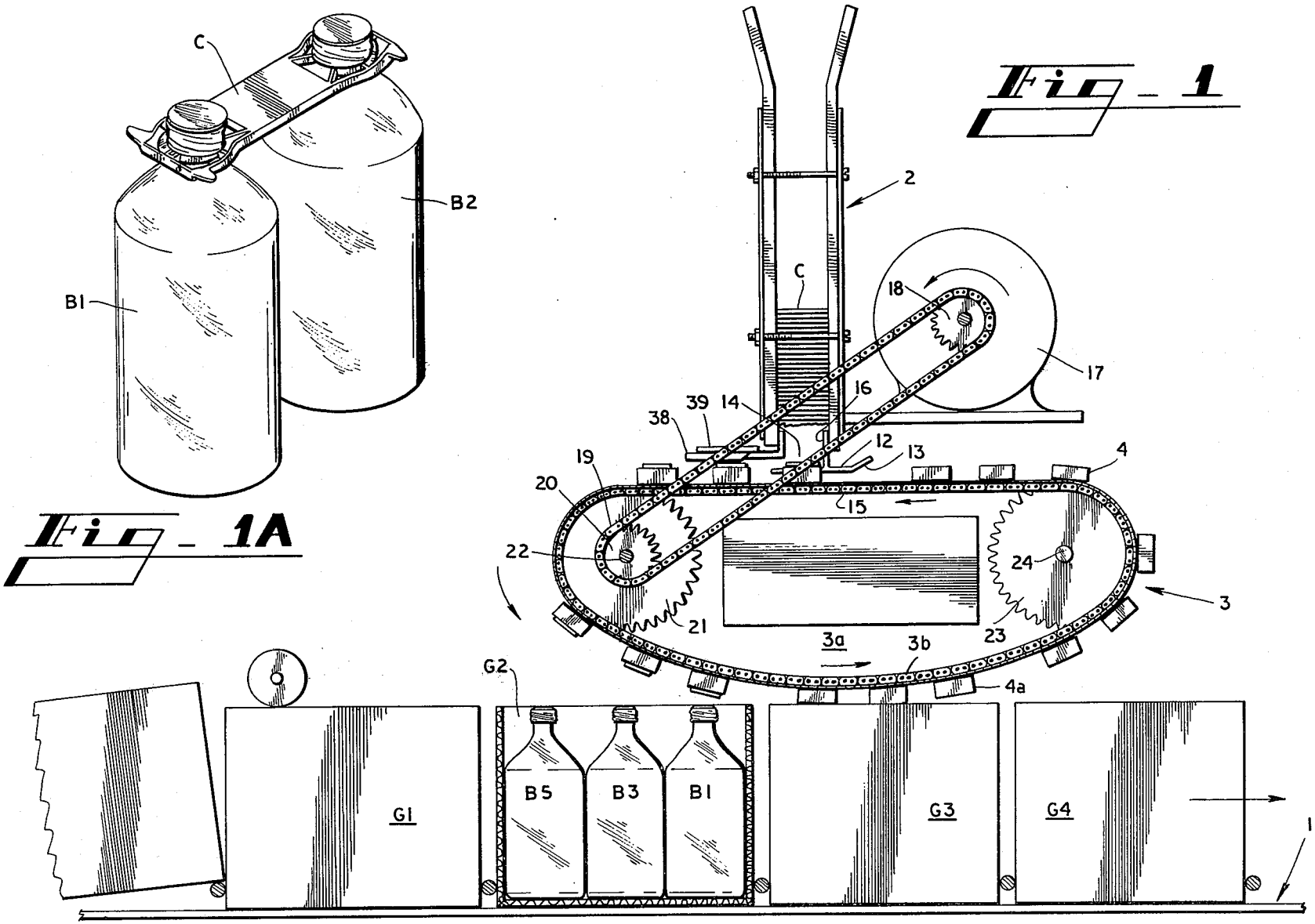
FIG. 1A is an enlarged perspective view of a group of articles to which a carrier has been applied.

In FIG. 1 the numeral 1 generally indicates a continuously moving conveyor on which a plurality of groups of articles such as G1, G2, G3 and G4 are arranged in fixed predetermined relationship. In FIG. 1 the numeral 2 generally designates a hopper structure in which a plurality of carriers generally designated at "C" are disposed and the numeral 3 generally designates an endless element on which a plurality of applicator blocks 4 are mounted in a predetermined fashion corresponding to the predetermined arrangement of the article groups G1, G2, G3, G4 and the like. The lowermost article carrier C in the hopper 2 is withdrawn from the hopper by an applicator block 4 and applied to a pair of articles such for example as B1 and B2.

Figure 2:
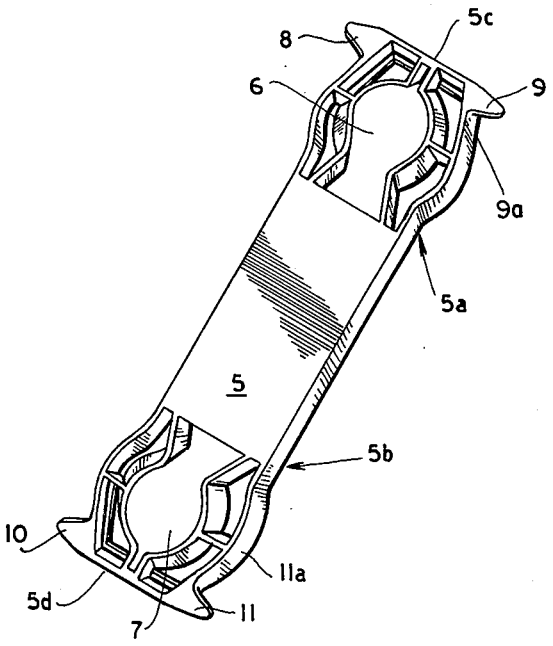
FIG. 2 is an enlarged perspective view of a carrier which is of the type which may be applied to a group of articles according to this invention.

The carrier is best shown in FIG. 2 in non-inverted carrying position and includes a central hand gripping portion designated by the numeral 5 and two end apertures designated by the numerals 6 and 7. When the carrier is applied to a pair of bottles, the necks of the bottles are inserted into the apertures 6 and 7 respectively and a gripping action secures the carrier about the bottle flanges in a manner which is well known. The carrier as shown in FIG. 2 includes four lateral projections designated by the numerals 8, 9, 10 and 11. The carrier of FIG. 2 forms the subject matter of U.S. application Ser. No. 485,727 filed July 3, 1974 now U.S. Pat. No. Des. 237,589 issued Nov. 11, 1975.

Figure 5:
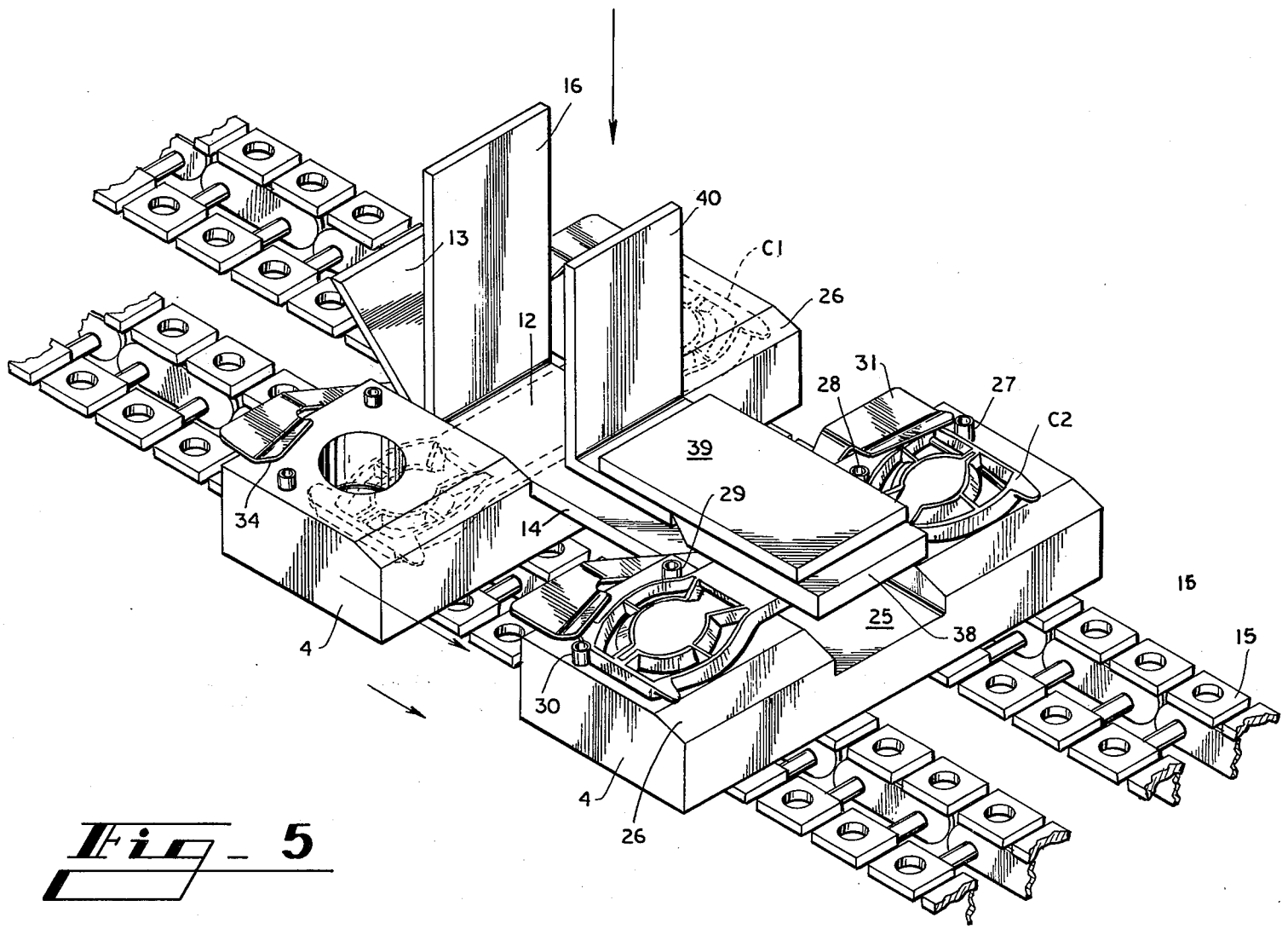
FIG. 5 is an enlarged perspective view of the lower portion of the hopper structure shown in FIG. 1 and which represents the cooperation between certain elements of the hopper and the specially constructed applicator blocks which are formed according to this invention.

As is shown in FIGS. 1 and 5, the carriers C are stacked in the hopper 2 and are supported by support bar 12 which is provided with an upstanding bevelled end portion 13, a horizontally disposed part 14 the free end of which extends in the direction of movement of the upper horizontal working reach 15 of endless element 3. Support bar 12 is held in position by vertical element 16 which is secured to a part of the hopper structure 2 and to the bar 12. From the drawings it is apparent that the end 14 of support bar 12 is a cantilever type structure on which the carriers "C" are mounted in generally transverse relation. The carriers "C" are inverted in the hopper 2.

For imparting operating movement to endless element 3, an electric motor 17 is provided with a sprocket 18 and by this means drives a chain 19 which operates sprocket 20 and in turn sprocket 21 which like sprocket 20 is fixedly mounted on shaft 22. Thus operation of motor 17 rotates sprocket 21 and in turn rotates idler sprocket 23 which is rotatable on fixed shaft 24. This operation of course imparts generally counterclockwise motion to endless element 3 as viewed in FIG. 1. As is apparent in FIG. 1, the lower reach of endless element 3 is arched downwardly due to the configuration of guide plate **3*a* having a guide edge 3*b* and its lowest point is tangentially disposed to an imaginary line parallel to the conveyor 1** and the downwardly facing surfaces of the applicator blocks are at or slightly below the tops of the bottles at the point of tangency to facilitate the application of the carriers.

Figure 4:
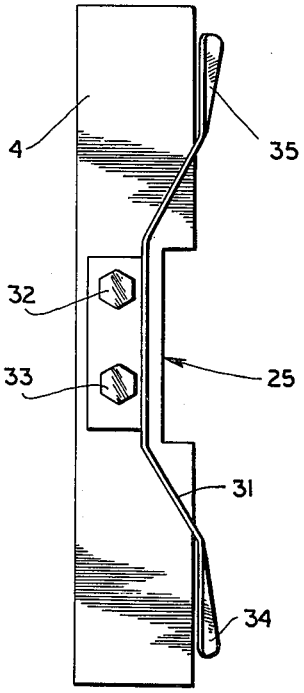
Figure 3:
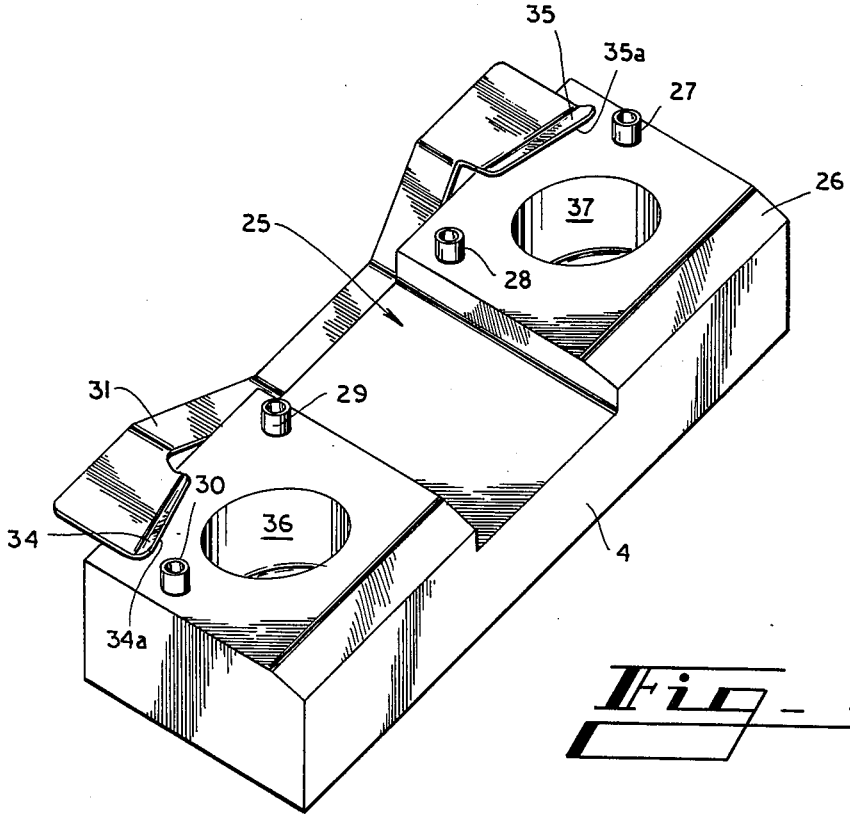
FIG. 3 is an enlarged perspective view of an applicator block constructed according to this invention.

As is best shown in FIGS. 3, 4 and 5 each support block 4 is constructed with a medial clearance slot 25 which as is apparent especially in FIG. 5 is arranged slidably to receive the horizontally disposed cantilevered portion 14 of the support bar 12. The leading edge of each support block is bevelled as indicated at 26. Abutment means in the form of studs 27, 28, 29 and 30 are mounted on each applicator block 4 and serve to engage the lowermost carrier as a particular applicator block 4 rides underneath the hopper 2 and with the support bar 12 slidably received in the clearance slot 25. Studs 28 and 29 engage the carrier at points **5*a* and 5*b* respectively and studs 27 and 30 engage the ends at 5*c* and 5*d* respectively. The clearance slot 25 preferably is sufficiently deep to accommodate the full thickness of cantilevered part 14 of support rod 12 and abutment studs 27–30 are sufficiently high to insure a positive and firm engagement with a side edge of the lowermost carrier. Engagement with the studs 27, 28, 29 and 30 of a carrier C of course moves the carrier from underneath its fellows. The carrier is securely held in place on its associated applicator block by holding means which may take the form of a leaf spring such as is designated by the numeral 31. Leaf spring 31 is affixed to each applicator block by means of a pair of screws 32 and 33 and each spring 31 is provided with a pair of upturned flaps 34 and 35. These flaps 34 and 35 simply override a pair of projections on the carrier such as are designated by the numerals 9 and 11 and by this means hold the carrier in position adjacent the holding means in the form of studs 27–30 thereby to insure the synchronous positioning of the carrier relative to its intended pair of bottles such as B1 and B2. When disposed on an applicator block 4, a carrier "C" is arranged with its edges 9***a* and 11*a* alongside edges 35*a* and 34*a* of the flaps 35 and 34.

For facilitating application of a carrier "C" to its associated bottles, a pair of recesses are formed in each applicator block and are designated by the numerals 36 and 37. Of course the upper portion of a bottleneck such as B1 may extend into the recess 36 and similarly the neck of bottle B2 may extend into the recess 37 during application of the carrier to the bottles. As the application operation is completed and as is apparent from FIG. 1, a particular applicator block such as that indicated at 4*a* moves out of contact with the bottles and leaves the carrier which is simply pulled from between its gripped position between the spring 31 and the block 4.

In FIG. 5 a carrier is shown immediately below the hopper 2 and below the horizontally disposed part 14 of the support bar 12 and the carrier is shown in dotted lines so as not to obscure the associated applicator block. This carrier is designated C1. Another carrier is designated C2 in FIG. 5 and shows the cooperation between the carrier such as C2 and a high friction drag pad designated by the numeral 38 which preferably is constructed of rubber and with its lower surface roughened or if a generally ridged or corrogated configuration so that engagement of drag pad 38 with the carrier C1 as the associated applicator block 4 moves generally toward the right as observed in FIG. 5 urges the carrier C2 backwardly and into snug and fixed engagement with the abutment means in the form of studs 27–30 inclusive. This drag pad 38 insures precise positioning of the carrier such as C2 on its associated applicator block and the carriers are held in this position by the holding means in the form of its associated leaf spring 31. Drag pad 38 is supported by a support plate 39 to which pad 38 is secured and by a bracket 40 secured in any suitable manner to hopper 2 and to plate 39.

It is apparent that by the invention high speed efficient removal of article carriers from a hopper and application of those carriers to their associated primary packages such as bottles is facilitated according to this invention.

While the arrangement shown in the drawings is well suited for many applications of the invention, it will be understood that the invention could take other forms. For example each applicator block could be formed of two transversely spaced parts with clearance space between these parts. The endless element could comprise a plurality of chains or if desired belt means could be employed. Furthermore carriers other than that shown could be applied by the insertion such for example as carriers for more than two bottles in which event the applicator blocks would include more than one clearance slot and more than one support bar should this be used.

The embodiments of the invention in which an exclusive property or privilege is claimed are defined as follows:

1. A method of supplying article carriers in sequence for application to groups of articles, the method comprising the steps of arranging the carriers in inverted vertically stacked relationship, supporting the stacked inverted carriers on a substantially horizontal carrier support bar mounted at one end only in cantilever fashion and with its free end extending in one direction, sequentially engaging the lowermost carrier and moving it in said one direction out of stacked relation with its fellows and off of said support bar, temporarily retarding movement of each carrier relative to the associated applicator block to urge the carrier into firm and secure engagement therewith, and reinverting the carriers in sequence for application to groups of articles.

2. A method according to claim 1 wherein movement of the carriers in sequence off of said support bar is at a slightly greater velocity than that at which the groups of articles are moved and in the same spaced relationship.

3. A machine for supplying article carriers in sequence for application to groups of articles, said machine comprising an endless element, a hopper mounted adjacent said endless element and having a carrier support bar disposed in generally parallel relation to the direction of movement of one reach of said endless element for supporting a stack of carriers, a plurality of applicator blocks mounted on said endless element and sequentially engageable with carriers in said hopper, each applicator block being configured to receive said carrier support bar, abutment means on each applicator block for engaging and removing a carrier from said hopper, and a high friction drag pad mounted on said hopper and arranged slidably to engage the carriers in sequence so as temporarily to retard the movement thereof relative to the associated applicator blocks respectively and to urge the carriers into secure and snug engagement with the associated abutment means thereby to position the carriers with precision on the associated applicator blocks respectively, and conveyor means for moving groups of articles along a predetermined path adjacent said endless element and in such manner that carriers are applied in sequence to the groups of articles respectively.

4. A machine according to claim 3 wherein holding means is mounted on each of said applicator blocks and engageable with a carrier for holding the carrier in a fixed position on the applicator block.

5. A machine according to claim 4 wherein said holding means comprises a leaf spring affixed to the trailing edge of the associated block and biased toward engagement with a part thereof adjacent said abutment means for urging a part of a carrier into firm engagement with the associated applicator block.

6. A machine according to claim 5 wherein said leaf spring includes a guide flap formed along its leading edge for facilitating entry of a part of a carrier between said leaf spring and the adjacent part of the associated applicator block.

7. A machine for supplying article carriers in sequence for application to groups of articles, said machine comprising an endless element, a hopper mounted adjacent said endless element and having a carrier support bar disposed in generally parallel relation to the direction of movement of one reach of said endless element for supporting a stack of carriers, a plurality of applicator blocks mounted on said endless element and sequentially engageable with carriers in said hopper, said carrier support bar being rigidly affixed to said hopper on the side thereof toward which said applicator blocks approach the hopper and wherein said support bar extends in cantilever fashion in the direction of movement of said applicator blocks, each applicator block having a clearance slot for slidably receiving said carrier support bar, abutment means on each applicator block for engaging and removing a carrier from said hopper, and conveyor means for moving groups of articles along a predetermined path adjacent said endless element and in spaced relation to each other so that carriers are applied in sequence to the groups of articles respectively.

8. A machine according to claim 7 wherein said abutment means comprises upstanding means on each applicator block and disposed on each side of each clearance slot.

9. A machine according to claim 7 wherein each applicator block is bevelled along is upper leading edge and on each side of said clearance slot.

10. A machine according to claim 7 wherein each applicator block includes at least one recess on each side of said clearance slot for facilitating removal of a carrier from the applictor block and application to a group of articles.

* * * * *